US011497090B2

(12) United States Patent
Wat

(10) Patent No.: US 11,497,090 B2
(45) Date of Patent: Nov. 8, 2022

(54) MICROWAVE OVEN, SYSTEM AND METHOD OF CONTROLLING THE SAME USING A SINGLE INPUT START BUTTON

(71) Applicant: Hubert Wat, Vancouver (CA)

(72) Inventor: Hubert Wat, Vancouver (CA)

(73) Assignee: Hub Strategy Inc., Vancouver (CA)

( * ) Notice: Subject to any disclaimer, the term of this patent is extended or adjusted under 35 U.S.C. 154(b) by 598 days.

(21) Appl. No.: 16/321,167

(22) PCT Filed: Jul. 29, 2016

(86) PCT No.: PCT/CA2016/050898
§ 371 (c)(1),
(2) Date: Jan. 28, 2019

(87) PCT Pub. No.: WO2018/018125
PCT Pub. Date: Feb. 1, 2018

(65) Prior Publication Data

US 2019/0174583 A1 Jun. 6, 2019

(51) Int. Cl.
*H05B 6/64* (2006.01)
*H05B 6/68* (2006.01)

(52) U.S. Cl.
CPC ..... *H05B 6/6435* (2013.01); *H05B 6/6411* (2013.01); *H05B 6/6414* (2013.01); *H05B 6/6447* (2013.01)

(58) Field of Classification Search
CPC .. H05B 6/6411; H05B 6/6414; H05B 6/6435; H05B 6/6447
USPC ..... 219/702, 703, 704, 714, 489, 720, 725, 219/506, 710, 719, 492, 508, 486, 496, 219/491, 493, 499, 510, 707, 711, 757; 99/325–335, 342, 348, 467, 483, 484, 99/486, 451; 426/504, 512, 523, 243; 366/69, 96–98, 144–146, 149, 319, 341, 366/601
See application file for complete search history.

(56) References Cited

U.S. PATENT DOCUMENTS 3,407,279 A 10/1968 Greenberg
4,507,530 A * 3/1985 Smith ..... H05B 6/6447 219/703
5,147,068 A * 9/1992 Wright ..... H05B 6/808 221/9

(Continued)

FOREIGN PATENT DOCUMENTS

CN 203517920 U 4/2014
EP 0688146 A2 12/1995

(Continued)

OTHER PUBLICATIONS

International Search Report for Application PCT/CA2016/050898 dated Apr. 7, 2017.

(Continued)

*Primary Examiner* — Quang T Van
(74) *Attorney, Agent, or Firm* — Patrick M. Torre; Stites & Harbison, PLLC

(57) ABSTRACT

A microwave oven with a control panel assembly with a limited number of operating buttons is provided. The microwave oven has a control panel assembly which has either a first single-input start button associated with a first pre-set cooking time or two single-input start buttons associated with two pre-set cooking times.

15 Claims, 2 Drawing Sheets

FIG. 1B

(56) References Cited

U.S. PATENT DOCUMENTS

| | | | | |
|---|---|---|---|---|
| 5,493,119 | A | 2/1996 | Torngren | |
| 5,558,799 | A | 9/1996 | Kang | |
| 8,835,821 | B2 | 9/2014 | Zeijlon | |
| 2004/0149743 | A1* | 8/2004 | Ryu | H05B 6/6435 219/702 |
| 2013/0020315 | A1* | 1/2013 | Tatsumu | H05B 6/6411 219/725 |
| 2014/0208957 | A1* | 7/2014 | Imai | F24C 7/082 99/342 |
| 2014/0356495 | A1* | 12/2014 | Teuscher | F24C 7/082 426/231 |

FOREIGN PATENT DOCUMENTS

| | | | |
|---|---|---|---|
| EP | 1408721 | A2 | 4/2004 |
| EP | 1450583 | A2 | 8/2004 |
| JP | S52-48857 | A | 4/1977 |
| JP | S57-121805 | U | 7/1982 |
| JP | H09-280567 | A | 10/1997 |
| JP | 2000012212 | A | 1/2000 |
| JP | 2003-028432 | A | 1/2003 |

OTHER PUBLICATIONS

N.A N.A, "DE Gebrauchsanweisung GB Instructions for use", Internet, operation manual from website, (Mar. 31, 2012), pp. 1-144, URL: https://www.severin.de/import/files/MW.
Midea Microwave Oven EM7KCG4-NR Service Manual.

* cited by examiner

MICROWAVE OVEN, SYSTEM AND METHOD OF CONTROLLING THE SAME USING A SINGLE INPUT START BUTTON

CROSS REFERENCE TO RELATED APPLICATION

The present application is a 371 national phase filing of PCT Application No. PCT/CA2016/050898, filed Jul. 29, 2016, which is hereby incorporated by reference in its entirety.

FIELD OF INVENTION

This disclosure relates to a microwave oven, system and method of controlling the same using one or more than one single input start button. More specifically, the present disclosure is directed to microwave oven with a control panel assembly with a limited number of operating buttons.

BACKGROUND OF THE INVENTION

In general, microwave ovens are cooking appliances that cook, reheat or defrost food using microwaves instead of using other heating methods such as conduction, convection, or radiation.

A body of the microwave oven has a chamber formed on one side thereof for receiving food to be cooked, and a microwave generator disposed on the other side thereof for generating and radiating microwaves into the food in the chamber. Usually a control panel assembly is formed on the front side of the body. The control panel assembly has a front panel with plurality of buttons for controlling the operation of the microwave oven and for selecting various functions of the microwave oven.

With the diversification of functions of microwave ovens more buttons have been added to front panels of microwave ovens. These additional functions are usually accommodated by the arrangement of many single-functional buttons or the arrangement of a few multi-functional buttons on the front panel section of the microwave oven. By using the multi-functional buttons, the number of functional buttons can be reduced compared to using the single-functional buttons, and the appearance of the microwave oven may be simple.

However, both types of microwave oven control systems—many single-functional buttons or few multi-functional buttons—have drawbacks for users that desire or require a simple to use microwave oven. With the aforementioned microwave oven control systems, a user is required to perform a number of sequential steps in order to cook, heat or defrost food. These steps may be too complex and confusing for elderly users or users with dementia. As a result, these users may incorrectly set microwave heating times and overheat foods leading to potential burns or fire hazards.

U.S. Pat. No. 8,835,821 describes a microwave oven comprising a one-touch button user interface wherein removable one-touch buttons containing stored food and timing data are inserted into the microwave oven interface to activate a microwave heating cycle. However, while the use of a one-touch button simplifies the process of setting and initiating a microwave heating cycle, the need for multiple removable buttons for different foods that may be lost or misplaced has the potential to create additional complexity and confusion for users.

Japanese patent application JP2000012212 describes a microwave oven equipped with a setting wherein, upon completion of an initial microwave heating cycle, a subsequent microwave heating cycle cannot be initiated until after the expiration of a set period of time. Although the microwave setting described in JP2000012212 reduces the risk of potential burns and fire hazards resulting from multiple, successive microwave heating cycles, it does not address the risk of burns and fire hazards resulting from accidental time entry at the start of the initial microwave heating cycle. Furthermore, in instances where the initial microwave heating cycle is of insufficient duration to properly cook or reheat food, the microwave oven setting of JP2000012212 prevents the user from simply initiating an additional microwave heating cycle without first waiting for the set period of time to expire.

There is therefore a need for a microwave oven with a control panel assembly with a limited number of operating buttons that is easy to use.

SUMMARY OF THE INVENTION

This disclosure relates to a microwave oven and a system for controlling the same. More specifically, the present disclosure is directed to a microwave oven with a control panel assembly with a limited number of operating buttons.

It is an object of the present disclosure to provide an improved microwave oven and system for controlling the same that reduces the risk of user burns and fire hazards due to overheated food.

According to an aspect of the disclosure it is provide a microwave oven comprising a main body forming a cooking chamber having a front opening;

a microwave generator for supplying microwaves to the cooking chamber;

a door movable mounted to the body for selectively closing the opening;

a door sensor for sensing an open or close state of the door; and a control panel assembly comprising one or more than one operating button, the one or more than one operating button consisting of one or more than one start button for initiating microwave generation at a pre-set cooking time.

The one or more than one start button may comprise i) a first single-input start button associated with a first pre-set cooking time or ii) a first single-input start button and a second single-input start button; wherein the first start button is associated with a first pre-set cooking time and the second start button is associated with a second pre-set cooking time.

The first pre-set cooking time may be for example 1 minute and the second pre-set cooking time may be for example 2 minutes.

The pre-set cooking time may be associated with the one or more than one start button over one or more than one cooking cycle. The pre-set cooking time may be permanently associated with the one or more than one start button or the pre-set cooking time may be user adjustable. The pre-set cooking time does not reset at the completion of a cooking cycle. The pre-set cooking time remains associated with the one or more than one start button over more than one cooking cycle. The pre-set cooking time remains associated with the one or more than one start button over multiple cooking cycle.

The control panel assembly may further comprise an input panel comprising one or more than one pre-set cooking time button for inputting the pre-set cooking time and a locking device for locking the input panel. The control panel assembly may further comprise a clock and a clock panel with locking device. The locking device may be a cover. The control panel assembly does not comprises a power level button, an add time button, a single digit button, a clear button, a delay start button, a defrost button, an auto-defrost button, one or more than one convenience cooking button, an auto-reheat button, an off button, a stop button, a clear button, and/or other feature buttons.

The microwave oven may further comprise a time reset means resetting the cooking time to 0 minutes when the door is opened. The microwave oven may further comprise signaling means for signaling when the cooking time is completed. In addition, the microwave oven may comprise a smoke and/or vapour detector. The activation of the smoke and/or vapour detector may activate a signaling means. The signaling means may be a front panel light, an alarm system or both. The signaling means may be pre-set for extended activation until the door of the microwave oven is opened by a user. Activation of the smoke and/or vapour detector may stop the cooking cycle and may reset the cooking time to 0 minutes. In addition, the microwave oven may comprise a rotatable carousel.

In another aspect of the disclosure it is provide a microwave oven comprising a main body forming a cooking chamber having a front opening;

a microwave generator for supplying microwaves to the cooking chamber;

a door movable mounted to the body for selectively closing the opening;

a door sensor for sensing an open or close state of the door; and a control panel assembly comprising one or than one operating button, the one or more than one operating button consisting of a first single-input start button and a second single-input start button, wherein the first single-input start button is permanently associated with a first pre-set cooking time and the second single-input start button is permanently associated with a second pre-set cooking time.

In another aspect of the disclosure it is provide a microwave oven comprising a main body forming a cooking chamber having a front opening;

a microwave generator for supplying microwaves to the cooking chamber;

a door movable mounted to the body for selectively closing the opening;

a door sensor for sensing an open or close state of the door; and a control panel assembly comprising one or than one operating button, the one or more than one operating button consisting of a single-input start button, wherein the single-input start button is associated with a user adjustable pre-set cooking time, wherein the pre-set cooking time remains associated with the start button over multiple cooking cycle.

In another aspect, it is provided a control panel assembly for a microwave oven, the assembly comprising one or more than one operating button, the one or more than one operating button consisting of one or more than one start button for initiating microwave generation at a pre-set cooking time.

The one or more than one start button of the control panel assembly may comprise i) a first single-input start button associated with a first pre-set cooking time or ii) a first single-input start button and a second single-input start button; wherein the first start button is associated with a first pre-set cooking time and the second start button is associated with a second pre-set cooking time. The control panel may further comprises an input panel comprising one or more than one pre-set cooking time button for inputting the pre-set cooking time and a locking device for locking the input panel. The control panel assembly may further comprise a clock and a clock panel with an optional locking device. The locking device may be a cover. The control panel may further comprise a signaling means. The control panel assembly does not comprises a power level button, an add time button, a single digit button, a clear button, a delay start button, a defrost button, an auto-defrost button, one or more than one convenience cooking button, an auto-reheat button, an off button, a stop button, a clear button, and/or other feature buttons.

DETAILED DESCRIPTION

Figure 1A:
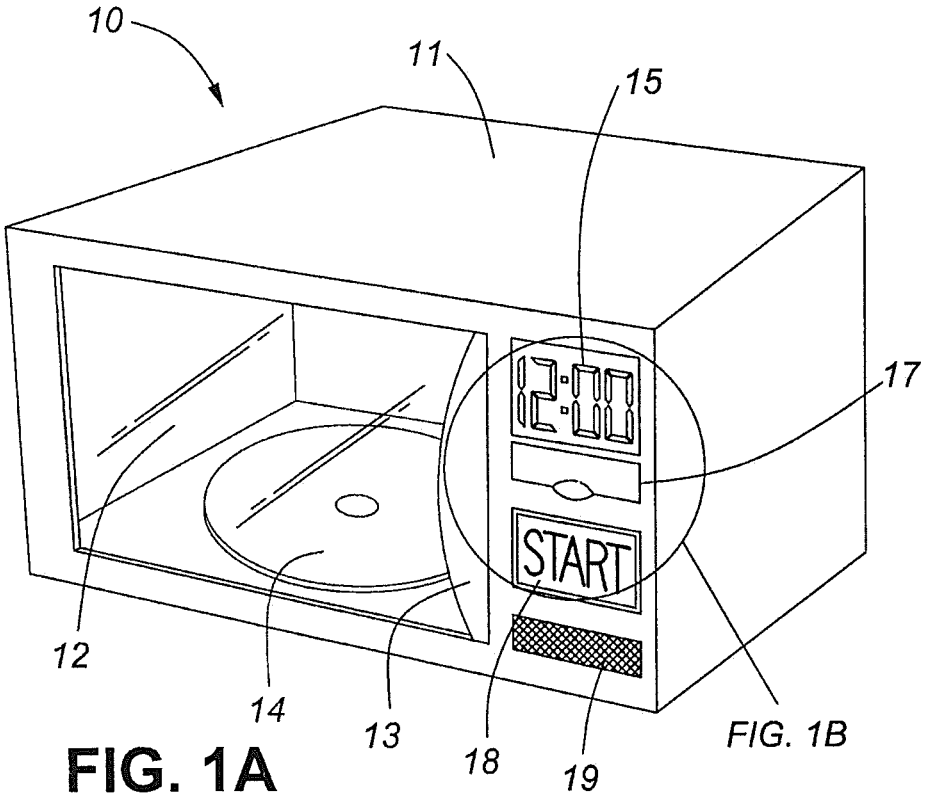
FIG. 1A shows a perspective view of a single input microwave oven in accordance with an embodiment.
Figure 1B:
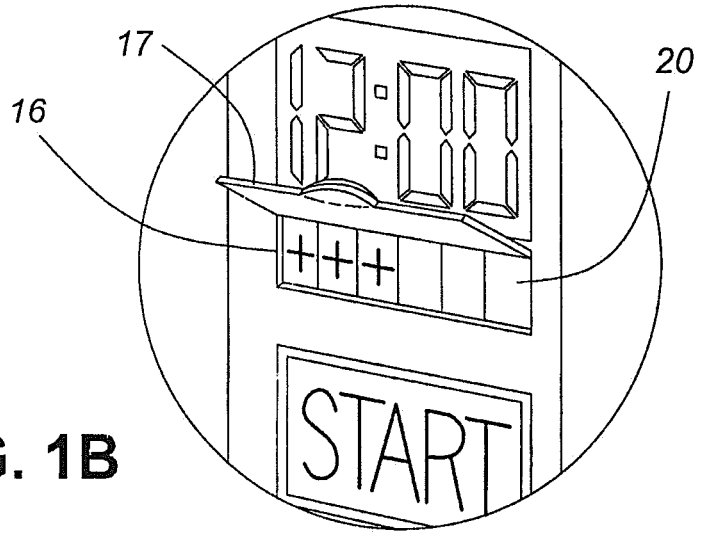
FIG. 1B shows a magnified view of an input panel with pre-set cooking time buttons, clock setting buttons and a cover for the input panel.

The present description relates to a microwave oven comprising a main body forming a cooking chamber having a front opening; a microwave generator for supplying microwaves to the cooking chamber; a door movable mounted to the body for selectively closing the opening; a door sensor for sensing an open or close state of the door; a control panel assembly comprising one or more than one operating button, the one or more than one operating button consisting of one or more than one start button for initiating microwave generation at a pre-set cooking time.

The one or more than one start button may comprise i) a first single-input start button associated with a first pre-set cooking time or ii) a first single-input start button and a second single-input start button; wherein the first start button is associated with a first pre-set cooking time and the second start button is associated with a second pre-set cooking time.

The present description further relates microwave oven control panels that either have one (a first) single-input start button associated with a first pre-set cooking time or a first single-input start button and a second single-input start button; wherein the first start button is associated with a first pre-set cooking time and the second start button is associated with a second pre-set cooking time.

With the microwave oven as describe herewith, a user is not able to initiate a microwave cooking cycle for longer than a preset cooking time and may only initiate another microwave heating cycle once the initial microwave heating cycle is complete or the microwave door has been opened and the preset amount of time has been automatically reset.

It has been found that microwave ovens with one single input start button associated with a pre-set cooking time or two single input start buttons associated with two pre-set cooking time as described herein will minimize and/or prevent overheating of food by users who, otherwise would either knowingly or by mistake, input or program too much time for a microwave heating or cooking cycle thereby increasing the risk of user burns or fire hazards. The microwave oven described herein is ideal for elderly individuals or users with dementia who are confused by multi-button interfaces, the task of programming microwave heating cycle times or are visually challenged. Accordingly, the microwave oven disclosed herewith may be suited for example for use in private homes, senior homes or assisted living facilities.

By "operating button" it is meant a user operated button that controls any function associated with the operation of the microwave oven. For example, operating buttons may be one or more than one start button or one or more than one control button. Non limiting examples of operating buttons include start buttons, cooking time buttons; power level buttons, add time buttons, single digit buttons, clear buttons, delay start buttons, defrost buttons or auto-defrost button, convenience cooking buttons, auto-reheat button, off buttons, clear buttons, and/or other feature buttons associated with the operation of the microwave oven. Convenience cooking buttons may include pre-programmed settings for different food types, such as meat, fish, poultry, vegetables, frozen vegetables, frozen dinners, and popcorn.

By "start button" it is meant a user operated button that initiates microwave generation by the oven upon operation by a user. The start button may be associated with a pre-set cooking time. The start button may be a single state or single input button ("on") also referred to as "single-input start button" or "single input start button". The start button may not be a two state button ("on" or "off"). Accordingly, repeated pressing of the start button will not switch between an "on" and "off" state. Repeated pressing of the start button may also not reset the pre-set cooking time and/or add cooking time to the initiated cooking cycle. For example, the microwave oven may initiate generation of microwaves in response to the start button being pressed by a user (the initiating input), and further pressing of the one or more than one start button (subsequent input) may not lead to the addition of cooking time to initiated cooking cycle. In contrast to known microwave oven wherein the cooking time of the microwave oven will have to be put in by the user at the beginning of each cooking cycle, in the microwave oven described herein the cooking time may be pre-set. Upon completion of a cooking cycle the pre-set cooking time will remain associated with the one or more than one start button.

The start button may be for example a press down button, a touch button, a dial, a knob, a lever or a switch. In one non-limiting embodiment, the start button is a rectangular button that is substantially the width of the control panel or half the width of the control panel. In another non-limiting embodiment the start button is at least half the width of the control panel.

The start button of the microwave oven described herewith is a "single-function button" or a "single-function start button". The start button is not a "multi-functional button". By "single-function button" or "single-functional button" it is meant a button which executes one function upon user input. A single-function button may not execute multiple-functions. An example of a single-functional button is a single function start button, which initiates the start and generation of microwaves in the microwave oven for a preset cooking time.

By "multi-functional button" it is meant a button by which a user may select a plurality of functions of the microwave oven. For example, a user may select a first function of the microwave oven by pressing the multi-functional button once, and a second function by pressing the multi-functional button once again, etc. In accordance with the number of times the multi-functional button is pressed, the respective functions of the microwave oven may be selected. Another example of a multi-functional button is a dial type knob, wherein multiple functions may be selected by dialing the knob to a desired function.

By "control button" it is meant a user operated button that controls the function or operation for example but not limited to the cooking time of a cooking cycle or power level of the microwave oven, but may not initiate the immediate generation of microwaves by the oven. Therefore a control button may not include one or more than one start button. Control button may comprise, but is not limited to, cooking time button, power level button, add time button, single digit button, clear button, delay start button, defrost buttons or auto-defrost button, auto-reheat button, off button, stop button, clear button, convenience cooking button, such as for example pre-programmed settings for different food types, such as meat, fish, poultry, vegetables, frozen vegetables, frozen dinners, and popcorn, and/or other feature button associated with the operation of the microwave oven. In one embodiment the control button may not include one or more than one clock setting button, one or more than one timer button or one or more than one pre-set cooking time button.

By "pre-set cooking time button", "preset cooking time button", "pre-set cooking button" or "preset cooking button" it is meant a button for input or adjustment of a pre-set cooking time by a user. The programming of the pre-set cooking time with the pre-set cooking time button allows for the customization of the pre-set cooking time by the user. Once the pre-set cooking time has been set by a user, the time will be associated with the one or more than one start button and will remain associated with the one or more than one start button until changed by the user. The pre-set cooking time remains associated with the one or more than one start button during repeated cooking cycles and is not automatically erased at the end of a cooking cycle. Therefore the cooking time will not have to be set at the beginning of every cooking cycle as with conventional microwave oven. Accordingly the pre-set cooking time may be a multiple cooking cycle pre-set cooking time and a cooking cycle is initiated for the preset cooking time by pressing the start button.

In another embodiment the pre-set cooking time might be permanently associated with the one or more than one start button and it might not be user adjustable. For example the microwave oven might come with a pre-set cooking time that is pre-set by the manufacturer of the microwave oven. In cases where the pre-set cooking time is permanently associated with the one or more than one start button, the microwave oven may not require a pre-set cooking time button. Therefore in some embodiment the microwave oven does not comprise a pre-set cooking time button.

The preset cooking time may be from about 5 seconds (sec) to 10 minutes (min) or any amount therebetween. For example the preset cooking time may be 5 sec, 10 sec, 15 sec, 20 sec, 30 sec, 40 sec, 50 sec, 1 min, 1.5 min, 2 min, 2.5 min, 3 min, 4 min, 5 min, 6 min, 7 min, 8 min, 9 min, 10 min or any amount therebetween. In one non limiting embodiment the preset cooking time may be 1 min or 2 min.

Another aspect of the present disclosure is a means whereby, upon the microwave oven door opening while a microwave heating cycle is in progress, the microwave heating cycle automatically terminates and the preset amount of time (preset cooking time) is automatically reset.

For example the door may have a door sensor for sensing an open or close state of the door. The cooking cycle may be pre-maturely terminated by opening the microwave oven door and activating the door sensor. When the door is opened all remaining cooking time is set to 0. Upon closing of the door and pressing of the start button, the initiated cooking cycle will run for the preset cooking time unless terminated again by opening of the door.

The door may have a door handle to open the door. In an alternative embodiment the door may be opened by pressing a push button that is located in the control panel of the microwave oven.

The microwave oven may further have a clock or clock panel for example the clock panel may be a diode display.

The control panel of the microwave oven may further have an input panel for setting the pre-set cooking time and/or setting the time of a clock that might be integrated in the microwave oven. The input panel may have a locking device for locking the panel or the buttons of the panel so that the buttons of the input panel may not be pressed unintentionally by a user. The locking device might be a cover or a flap. In another embodiment the buttons of the panel might be locking buttons that might be locked.

The microwave oven may further have signaling means to alert the user at the completion of a cooking cycle or to alert the user to a problem that may arise during the operation of the microwave oven. The signal means activated at the end of the cooking cycle remains activated until the door of the microwave oven is opened by the user. The signaling means may be pre-set for an extended activation time until the door of the microwave oven is opened by the user. The signal emitted by the signaling means may be for example a visible and/or audible signal. The signaling means may be for example a light such as for example a front panel light, a flashing alert light, a loudspeaker and/or an alarm system. Use of the signaling means may be optional and the signaling means may be turned on or off using an on and off button which is part of the input panel. Therefore a user may decide to operate the microwave oven without the signaling means being activated at the end of a cooking cycle.

When heated in a microwave oven, food normally gives off water vapour in a given phase of the heating procedure when the water in the food evaporates. The emission of vapour then indicates how the heating proceeds. If heating takes place at too high a power level, edge scorching may occur in some cases, which can result in the emission of smoke. When the cooking time and the power level have been clearly misset, the food may catch fire or get charred, resulting in heavy smoke emission. Accordingly, the microwave oven as described herewith may further comprise a smoke and/or vapour detector for detecting the presence of particles, such as smoke and water vapour in the cooking chamber. When the smoke and/or vapour detector is activated an alarm will be activated to alert the user. The alarm may be an audible and/or visual alarm. Furthermore, activation of the smoke and/or vapour detector may stop the cooking cycle and may reset the cooking time to 0 minutes.

The features and elements of the microwave oven described herewith are for safety and convenience of the user.

The following description is of preferred embodiments of the microwave oven disclosed herewith, examples of which are illustrated in the accompanying drawings. In describing the embodiments, identical parts will be given the same names and reference numbers.

A microwave oven 10 comprises a housing 11 defining an oven chamber 12 which receives food to be microwaved. A microwave generating means such as a microwave generator (not shown) is formed in one side of the housing 11 for generating and radiating microwaves of a certain frequency to the food in the oven chamber 12. Access to the oven chamber 12 is provided by a door and door handle 13. A rotatable carousel 14 is supported within the oven chamber 12. The microwave oven additionally comprises a light emitting diode display 15, which displays the time and, when a microwave heating cycle is in progress, the microwave heating timer. In the embodiment shown in FIG. 1A and the embodiment shown in FIG. 2, the displayed time is adjustable using buttons of input panel 16. In the embodiment of the microwave oven shown in FIG. 1A, the input panel 16 additionally functions to adjust the duration of the preset amount of time (pre-set cooking time) for the microwave heating cycle with pre-set cooking time button 20. The input panel 16 is covered by a input panel cover 17, which will deter users from making setting adjustments and minimize confusion for elderly users operating the microwave oven interface.

With reference to FIG. 1A, the single input embodiment also consists of a large single input start button 18 which, when activated, can initiate a microwave heating or cooking cycle for the pre-set cooking time. As depicted in FIG. 1A, the single input start button 18 cam be a button that is larger than the buttons of traditional microwaves and can have the word "START" on it in large, bold font. To operate the single input embodiment, a user simply places the food item to be cooked or re-heated in the oven chamber 12, closes the door using the door handle 13, and activates the single input start button 18 (e.g. presses the large "START" button), which will immediately start the microwave heating cycle without the need to press any additional buttons. Activating the single input start button 18 additional times will not multiply the preset amount of time. For example, in the single input embodiment with a preset amount of time for the microwave heating cycle set to 1.5 minutes, repeatedly pressing the large "START" button will not initiate a microwave heating cycle longer than 1.5 minutes. To microwave a food item for longer than 1.5 minutes, the user must wait until the first 1.5 minute microwave heating cycle completes, open the door to automatically reset the microwave heating timer, then press the "START" button to initiate another 1.5 minute microwave heating cycle.

Figure 2:
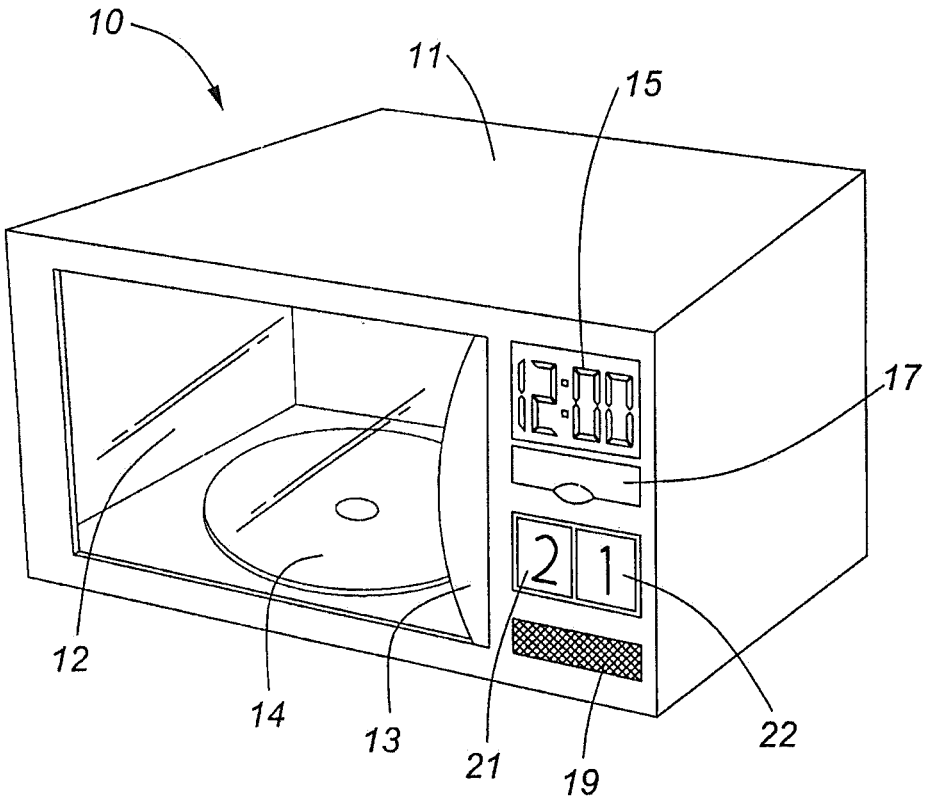
FIG. 2 shows a perspective view of a two input microwave oven in accordance with a further embodiment.

With reference to FIG. 2, the microwave oven interface of the two input embodiment consists of a first input start button 21 and a second input start button 22 which, when activated, can initiate microwave heating cycles for preset amounts of time lasting for example two minutes and one minute respectively. As shown in FIG. 2, the two inputs can be buttons that are larger than the buttons of traditional microwave ovens and may have "2 MINUTES" and "1 MINUTE" on the corresponding buttons in large, bold font.

To operate the two input embodiment, a user places the food item to be cooked or reheated in the oven chamber 12, closes the door using the door handle 13, and activates either the first start button 21 (e.g. presses the "2 MINUTE" button), which will immediately start a preset microwave heating cycle for a preset amount of time lasting two minutes, or the second start button 22 (e.g. presses the "1 MINUTE" button), which will immediately start a microwave heating cycle for a preset amount of time lasting one minute. Activating the first or second start button multiple times or in combination will not increase the duration of the microwave heating cycle for longer than two minutes, if the first start button 21 is initially activated, or for longer than one minute, if the second start button 22 is initially activated.

Once the microwave heating or cooking cycle is complete, a beeping alert may be activated to notify the user of the completion of the microwave heating cycle and to remind the user that a food item is in the oven chamber 12. The beeping may continue to sound until the microwave oven door is opened and the microwave heating timer is reset. In embodiments equipped with an optional flashing alert light 19, the flashing alert light may also be activated upon completion of the microwave heating operation and may remain active until the microwave oven door is opened and the microwave heating timer is reset.

Like traditional microwave ovens, opening the door while the microwave heating cycle is in progress will automatically stop the microwave heating cycle. However, unlike traditional microwave ovens, opening the microwave oven door will automatically reset the microwave oven heating time. For example, opening the microwave door with 32 seconds of the preset amount of time for the microwave heating cycle remaining will automatically reset the microwave heating timer for the next use. In traditional microwave ovens, the remaining 32 seconds would carry-over and be added to the microwave heating time of the next use unless manually reset by the user.

Some embodiments may also include an optional smoke and/or vapour detector (not shown). Upon detecting smoke and/or vapour in the oven chamber 12, the microwave heating cycle will automatically terminate, the microwave timer will reset, the beeping alert will be activated and, if present, the optional flashing alert light 19 will be activated.

The present invention has been described with regard to one or more embodiments. However, it will be apparent to persons skilled in the art that a number of variations and modifications can be made without departing from the scope of the invention as defined in the claims.

What is claimed is:

1. A microwave oven comprising:

a main body forming a cooking chamber having a front opening;

a microwave generator for supplying microwaves to the cooking chamber;

a door movably-mounted to the main body for selectively closing the front opening;

a door sensor for sensing an open state of the door or close state of the door; and a control panel assembly consisting of one of:

i) a control panel having one single-input pre-set cooking time start button for initiating microwave generation at a pre-set cooking time, wherein the pre-set cooking time remains permanently associated with the one single-input pre-set cooking time start button over more than one cooking cycle and further wherein repeated pressing of the one single-input pre-set cooking time start button does not reset the pre-set cooking time or add cooking time to the initiated cooking cycle; or ii) a control panel having two single-input pre-set cooking time start buttons each for initiating microwave generation at pre-set cooking times, wherein the pre-set cooking times remain permanently associated with each of the two single-input pre-set cooking time start buttons over more than one cooking cycle and wherein repeated pressing of the two single-input pre-set cooking time start buttons does not reset the pre-set cooking times or add cooking time to the initiated cooking cycle;

further wherein the two single-input pre-set cooking time start buttons consist of a first single-input pre-set cooking time start button associated with a first pre-set cooking time and a second single-input pre-set cooking time start button associated with a second pre-set cooking time that is different from the first pre-set cooking time.

2. The microwave of claim 1, wherein the microwave further includes:

an input panel including:

one or more than one pre-set cooking time buttons for inputting a pre-set cooking time; and a locking device for locking the input panel.

3. The microwave oven of claim 1, wherein the microwave further includes:

a clock; and a clock panel including a locking device.

4. The microwave oven of claim 3, wherein the locking device is a cover.

5. The microwave oven of claim 1, further comprising:

means for signaling when the pre-set cooking time is completed.

6. The microwave oven of claim 5, wherein the means for signaling comprises a front panel light.

7. The microwave oven of claim 1, further comprising one or more of:

a smoke detector; and a vapor detector.

8. The microwave oven of claim 7, wherein activation of one or more of the smoke detector and the vapor detector activates a signaling device.

9. The microwave oven of claim 8, wherein the signaling device includes one or more of:

a front panel light; and an alarm system.

10. The microwave oven of claim 9, wherein the signaling device further includes:

an activation timer that is pre-set to an extended activation time until the door of the microwave oven is arranged in the open state.

11. The microwave oven of claim 7, wherein activation of one or more of the smoke detector and the vapor detector stops a cooking cycle and resets a cooking time to 0 minutes.

12. The microwave oven of claim 1, further comprising:

a rotatable carousel.

13. The microwave oven of claim 1, further comprising:

means for resetting a cooking time to 0 minutes when the door is arranged in the open state.

14. A microwave oven comprising:

a main body forming a cooking chamber having a front opening;

a microwave generator for supplying microwaves to the cooking chamber;

a door movably-mounted to the main body for selectively closing the front opening;

a door sensor for sensing an open state of the door or close state of the door;

means for resetting a cooking time to 0 minutes when the door is arranged in the open state; and a control panel assembly consisting of one of:

i) a control panel having a first start button arrangement including a single-input pre-set cooking time start button associated with a pre-set cooking time; or ii) a control panel having a second start button arrangement including a first pre-set cooking time single-input start button and a second pre-set cooking time single-input start button, wherein the first single-input pre-set cooking time start button is associated with a first pre-set cooking time, and wherein the second single-input pre-set cooking time start button is associated with a second pre-set cooking time that is different than the first pre-set cooking time;

wherein the microwave oven further comprises a front panel light for signaling when the first pre-set cooking time and/or the second pre-set cooking time is complete.

15. The microwave oven of claim 14, wherein the microwave further includes:

an input panel including:

one or more than one pre-set cooking time button for inputting a pre-set cooking time; and a locking device for locking the input panel.

* * * * *